US007344336B1

(12) United States Patent
Baugh

(10) Patent No.: US 7,344,336 B1
(45) Date of Patent: Mar. 18, 2008

(54) METHOD OF PROVIDING CLEAR WATER FOR BEACHES

(76) Inventor: Benton Frederick Baugh, 14626 Oak Bend, Houston, TX (US) 77079

( * ) Notice: Subject to any disclaimer, the term of this patent is extended or adjusted under 35 U.S.C. 154(b) by 491 days.

(21) Appl. No.: 11/040,306

(22) Filed: Jan. 24, 2005

(51) Int. Cl.
*E02B 3/00* (2006.01)

(52) U.S. Cl. ..... 405/80; 405/15; 405/303; 210/170.11

(58) Field of Classification Search ..... 405/15, 405/73, 74, 80, 303; 210/170.11
See application file for complete search history.

(56) References Cited

U.S. PATENT DOCUMENTS 3,565,491 A * 2/1971 Frazier ..... 405/74
4,898,495 A * 2/1990 Lin ..... 405/74
5,022,784 A * 6/1991 DeVries et al. ..... 405/15
5,061,117 A * 10/1991 Parks ..... 405/74
5,105,094 A * 4/1992 Parker ..... 290/53
5,149,227 A * 9/1992 Parks ..... 405/15
5,256,310 A * 10/1993 Brooks ..... 405/127
5,294,213 A * 3/1994 Parks ..... 405/73
6,386,795 B1 * 5/2002 Delbaere ..... 405/15
6,547,486 B1 * 4/2003 Jakobsen ..... 405/15
6,575,662 B2 * 6/2003 French ..... 405/78

* cited by examiner

*Primary Examiner*—Frederick L. Lagman

(57) ABSTRACT

A method of providing clear ocean water near a shoreline comprising providing a pump with inlet and outlet piping, locating the inlet to said inlet piping at a distal location from said shoreline where the ocean water is clear, locating one or more outlets on said outlet piping proximate said shoreline, and pumping clear water from said distal location to said proximate location, and displacing the water proximate the shoreline.

20 Claims, 4 Drawing Sheets

METHOD OF PROVIDING CLEAR WATER FOR BEACHES

CROSS-REFERENCE TO RELATED APPLICATIONS

N/A

STATEMENT REGARDING FEDERALLY SPONSORED RESEARCH OR DEVELOPMENT

N/A

INCORPORATION-BY-REFERENCE OF MATERIAL SUBMITTED ON A COMPACT DISK

N/A

BACKGROUND OF THE INVENTION

The field of this invention is that of providing an environmentally friendly area for recreation and living in a beach area near an ocean where the slope of the beach is slight enough to retain the silt which tends to build up in the water and cause it to be cloudy. Typically, the water near shallow beaches does not "flow" as the waves come in, but rather it would be typified as the water simply churning in place. A wave is a wave of energy passing toward the beach, but little net flow of water typically occurs. The result of this is that a suspension of fine particulate matter occurs which discolors the water, making it cloudy and unappealing. If you were to collect a gallon of this beach water, it would sometimes clarify in a few hours if the particulate matter were heavy, or would simply stay colored if the particulate matter was as light as water. If it is heavy, the constant churning of the waves keeps the matter in suspension, keeping the water cloudy.

BRIEF SUMMARY OF THE INVENTION

The object of this invention is to provide a method to provide clear clean water near a beach.

A second object of the present invention is to provide a method to move the cloudy water near the beach to a location away from the beach.

A third object of the present invention is to provide a method to bring water which is not clouded to the area near the beach.

Another object of the present invention is to provide means to allow the clear water outlets to be maintained flush with the seafloor.

BRIEF DESCRIPTION OF SEVERAL VIEWS OF THE DRAWINGS

FIG. No. 1 is a section taken thru a beach and the adjacent ocean waters illustrating that near the beach the water can be cloudy while at a location offshore, the water can be clear.

FIG. No. 2 is the same section thru the beach showing equipment of the method of this invention in place.

FIG. No. 3 is the same section thru the beach with the equipment of this method turned on and clearing the water near the beach.

FIG. No. 4 is a perspective view of the same beach showing the seafloor protrusions of the equipment of this method.

FIG. No. 5 is the same perspective showing the piping under the seafloor.

FIG. No. 6 is a view of a seafloor grating which can be rotated to regulate the sea water flow at that loctaion.

FIG. No. 7 is a half section showing the sea water distribution pipe with a variable flow grating at the top which would be at the sea floor and with a threaded connection to allow the height of the variable flow grating to be adjusted upwards.

DETAILED DESCRIPTION OF THE INVENTION

Figure 1:
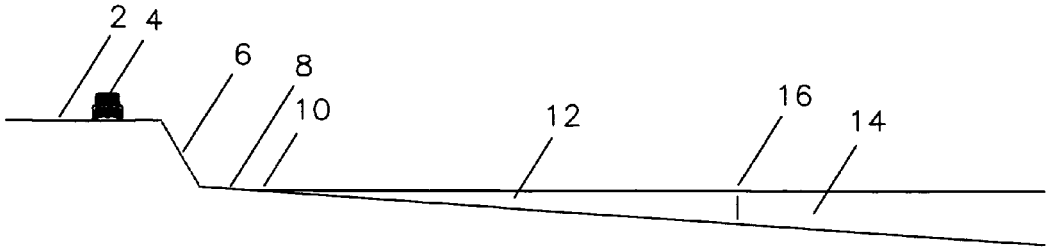

FIG. 1 shows a road 2 with a car 4, a seawall 6, a beach 8, and the edge of the water in the ocean 10. Clear beach water 12 is shown and clear ocean water 14 is shown with a general area 16 dividing the cloudy beach water from the clear ocean water.

Figure 2:
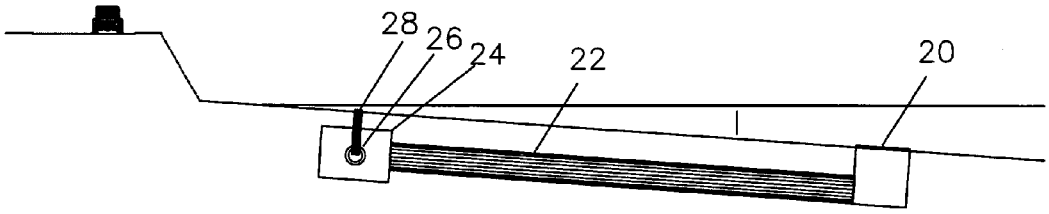

Referring now to FIG. 2, equipment of this invention is shown below the seafloor. Ocean water inlet 20 is shown approximately flush with the sea floor so as to not be an obstruction with fishing nets or other equipment. It will have protective bars so that any inquisitive fish or diver would be prevented from entering. Although the actual suction pressure will be low, a pressure sensor will be installed within the inlet 20 to detect is anyone or anything lands on top of the grating. If anyone or anything lands on the top, the flow will be stopped or reversed to allow the person or thing to be removed.

Pipe 22 connects the inlet 20 to the pumping system 24. Depending on the flow rate for the desired location, this pipe will be in the order of 4 to 5 feet in diameter. As will be seen later, horizontal pipes 26 run parallel to the beach and have vertical water outlets 28.

Figure 3:
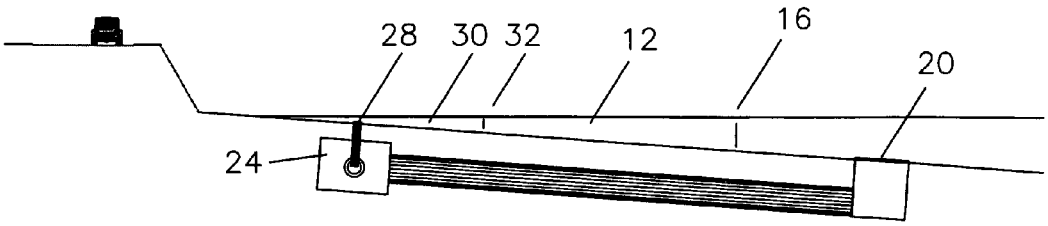

Referring now to FIG. 3, the pumping system 24 is turned on and clear water 14 is sucked into the inlet 20 and exits the outlets 28. This causes clear water to be expelled along the beach, pushing the cloudy water 12 away from the beach. A lower continuous flow will keep the water near the beach clear. A sufficiently high flow will push the cloudy water far enough out to sea for it to disappear in ocean current.

Figure 4:
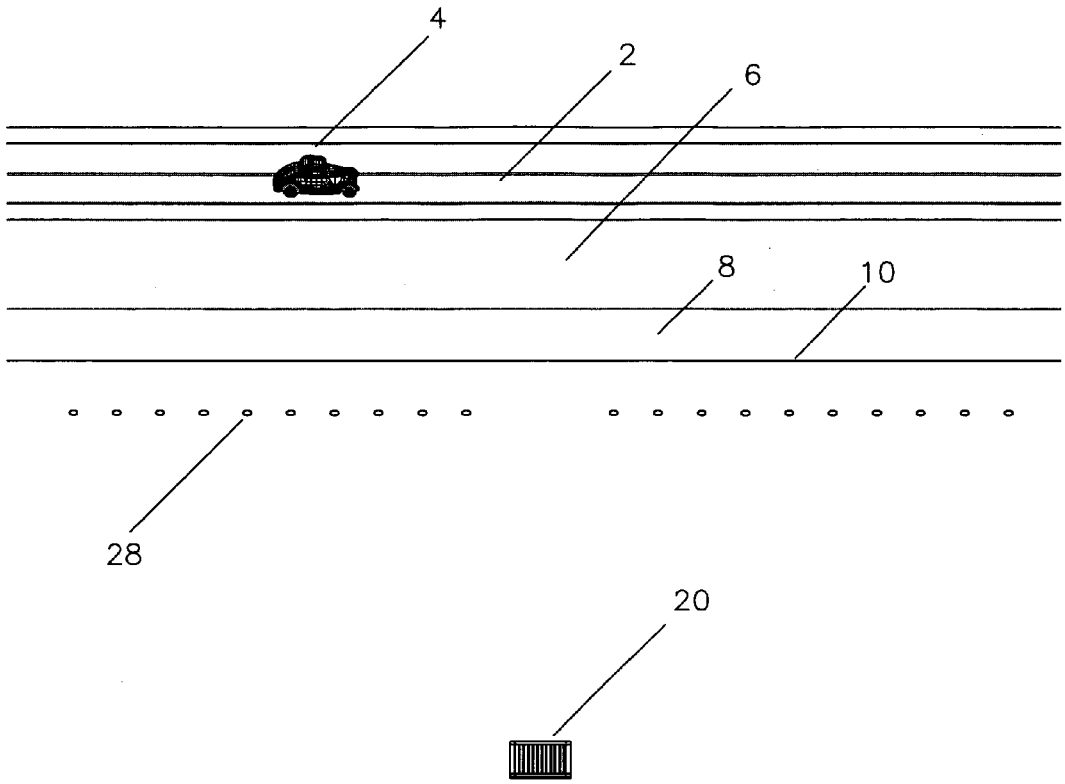

Referring now to FIG. 4, a perspective view is shown illustrating inlet 20 offshore and outlets 28 near the beach. In this case a seawall 6 is shown as exists in Galveston, Tex., but the method will work equally well on plain beaches.

Figure 5:
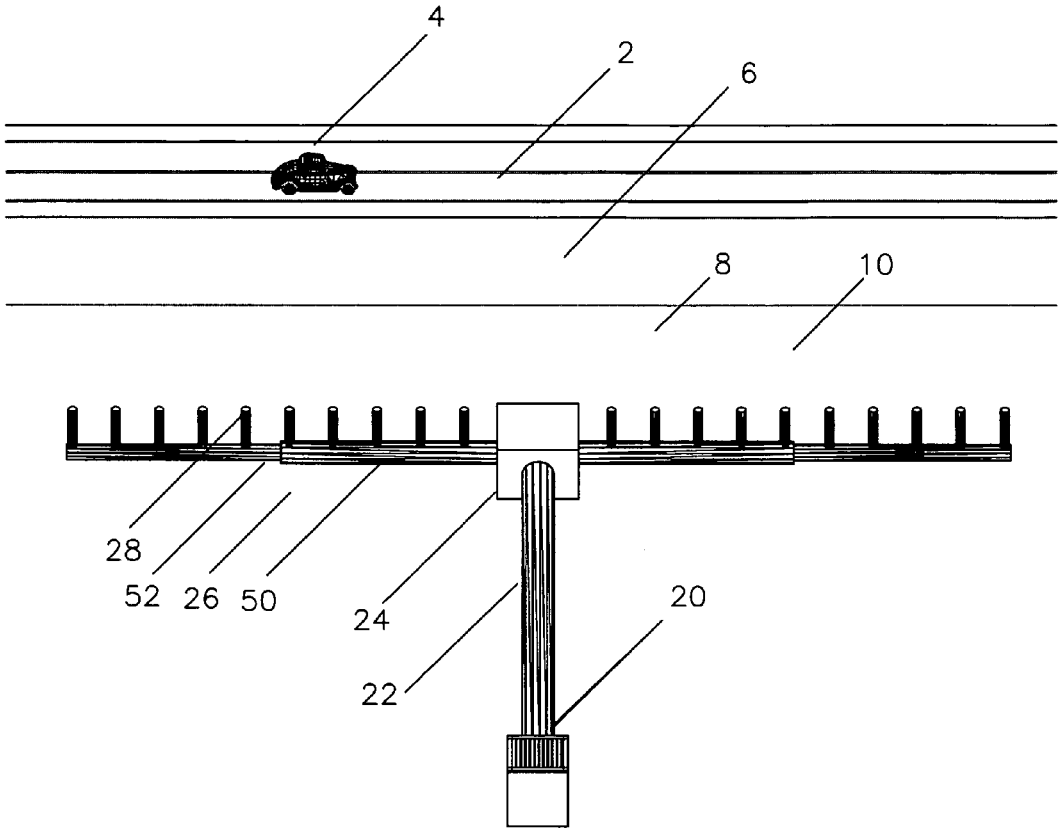

Referring now to FIG. 5, a similar view is seen to FIG. 4, with the sand removed. The below the seafloor pipes can be seen including the runs of pipe 26 each direction from the pumping system. Pipes 26 can be divided into multiple sections 50 and 52 to optimize flow as the flow rate decreases as part of the water leaves thru outlets 28.

Figure 6:
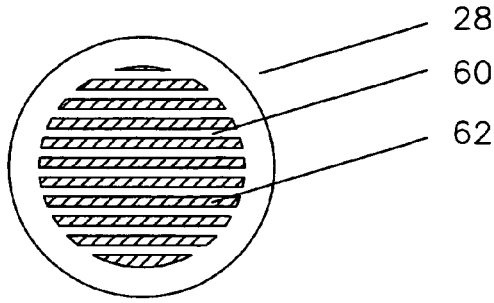

Referring now to FIG. 6, the top one of the outlets 28 is shown with a series of parallel bars 60 at a level and a series of parallel bars 62 at an adjacent location. Manipulation of the relationship of the bars can be used to restrict or allow greater flow thru the outlets 28. In the particular embodiment shown, rotation of the bars 62 will be manipulation used to change the allowable flow.

Figure 7:
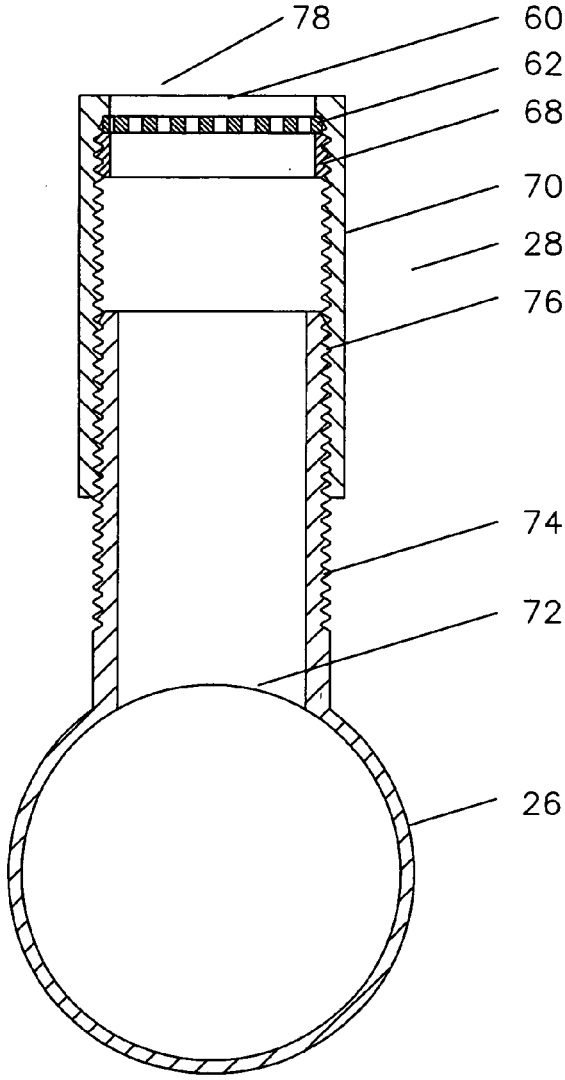

Referring now to FIG. 7, the parallel bars 62 are shown to be constructed in a plate with nut 68 holding them in place. The bars 60 and 62 as well as the nut 68 are mounted in an upper section 70. A hole 72 penetrates the top of the run of pipe 26 and a vertical pipe section 74 is attached above the hole. The vertical pipe section 74 is externally threaded and the upper section 70 is internally threaded such that rotation of the upper section 70 will cause a change in the height of the top 78 of the upper section 70. This adjustment will allow the top 78 of the upper section 70 to be maintained flush with seafloor so as to not be an obstruction for tourists, and not be an erosion causing interruption to the normal water flows.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

The invention claimed is:

1. The method of providing clear ocean water near a shoreline comprising providing a pump with inlet and outlet piping, locating the inlet to said inlet piping at a distal location from said shoreline where the ocean water is clear, locating one or more outlets on said outlet piping proximate said shoreline, and pumping clear water from said distal location to said proximate location, and displacing unclear water proximate the shoreline.

2. The method of claim 1, further comprising sensing a pressure decrease at the inlet as an indication that someone or something might be blocking the flow.

3. The method of claim 1, further comprising said pump being located proximate said shoreline and having 2 or more outlet pipes, each having 2 or more outlets.

4. The method of claim 3, further comprising that the flow area within said 2 or more outlet pipes has at least one reduction in size along the length of said outlet pipe.

5. The method of claim 1, further comprising said pump being located at a distal location from said shoreline.

6. The method of claim 1, further comprising said pump is completely below the seafloor.

7. The method of claim 1, further comprising that flow out of individual outlets can be independently regulated.

8. The method of claim 1, further comprising that the height of individual outlets can be independently adjusted.

9. The method of clearing water near a shoreline comprising providing a pump with inlet and outlet piping, locating the inlet to said inlet piping at a distal location from said shoreline where the water is clear, locating one or more outlets on said outlet piping proximate said shoreline, and pumping clear water from said distal location to said proximate location, and displacing unclear water proximate the shoreline.

10. The method of claim 9, further comprising sensing a pressure decrease at the inlet as an indication that someone or something might be blocking the flow.

11. The method of claim 9, further comprising said pump being located proximate said shoreline and having 2 or more outlet pipes, each having 2 or more outlets.

12. The method of claim 11, further comprising that the flow area within said 2 or more outlet pipes has at least one reduction in size along the length of said outlet pipe.

13. The method of claim 9, further comprising said pump being located at a distal location from said shoreline.

14. The method of claim 9, further comprising said pump is completely below the seafloor.

15. The method of claim 9, further comprising that flow out of individual outlets can be independently regulated.

16. The method of claim 9, further comprising that the height of individual outlets can be independently adjusted.

17. The method of providing clear ocean water near a shoreline comprising providing a pump with inlet and outlet piping, locating the outlet to said inlet piping at a distal location from said shoreline, locating one or more inlets on said outlet piping proximate said shoreline, and pumping water from said proximate location to said distal location, and displacing the water proximate the shoreline and allowing clear water to come in its place.

18. The method of claim 17, further comprising sensing a pressure decrease at the inlet as an indication that someone or something might be blocking the flow.

19. The method of claim 17, further comprising that flow out of individual inlets can be independently regulated.

20. The method of claim 17, further comprising that the height of individual inlets can be independently adjusted.

* * * * *